United States Patent [19]

Eylander

[11] Patent Number: 5,076,575

[45] Date of Patent: Dec. 31, 1991

[54] WEIGHT BELT

[76] Inventor: Hans Eylander, 155 Burbridge Road, Hilton, South Australia, 5033, Australia

[21] Appl. No.: 621,608

[22] Filed: Dec. 3, 1990

[30] Foreign Application Priority Data

Apr. 12, 1989 [AU] Australia ..... PJ7691

[51] Int. Cl.[5] ..... A63B 21/00

[52] U.S. Cl. ..... 272/119; 272/143; 405/186

[58] Field of Search ..... 272/119, 96, 116, 117; 128/402, 403; 405/186; 224/228, 229; 2/311, 312

[56] References Cited

U.S. PATENT DOCUMENTS 3,851,488 12/1974 Schuler ..... 485/186
3,924,851 12/1975 Winston ..... 272/119 X
4,440,525 4/1984 Perla ..... 405/186
4,592,358 6/1986 Westplate ..... 272/119 X
4,966,365 10/1990 Winston ..... 272/119

FOREIGN PATENT DOCUMENTS 1568081 5/1980 United Kingdom ..... 272/119

*Primary Examiner*—Richard J. Apley
*Assistant Examiner*—D. F. Crosby
*Attorney, Agent, or Firm*—Brown, Martin, Haller & McClain

[57] ABSTRACT

A weight belt comprises a sheet of flexible material having two strips of material over one face and joined by stitching seams to form a number of pockets side-by-side, the pockets containing plates of lead, and being closed by further folding of the sheet to bring the pockets face to face, where they are retained by touch-and-hold material. They can be lifted away for adding or reducing the number of lead plates. Access to some of the plates can be provided to allow removal or replacement without necessarily removing the belt.

7 Claims, 2 Drawing Sheets

WEIGHT BELT

This invention relates to a weight belt, and is particularly useful as a diver's weight belt although the use is not necessarily limited to diving.

BACKGROUND OF THE INVENTION

Weight belts which are most commonly used for diving comprise apertured lead weights through which a belt is passed, and the two ends of the belt are secured together by a quick release buckle.

There are several difficulties which are encountered with conventional weight belts.

Firstly, it is desirable that a person should be capable of carefully adjusting the weights in the weight belt to compensate for the buoyancy of the human body and its wet suit, and although belts with multiple weights thereon have been known in the past, so much slippage occurs when in use that they have lost favour to a more recent design wherein there are only two, or at the most four weights on a belt, and the weights are much larger and heavier than those which were used earlier but have less tendency to slip. When a small number of weights are used on a belt, the load is carried mostly on the hips and lower back of a wearer, where it can rub and cause discomfort. They are also bulky, having a "high profile", and sometimes interfere with other diving equipment. It is an object of this invention to provide a weight belt which is less likely to interfere with ancillary equipment.

It is most desirable to avoid fatigue when swimming under water, and fatigue can be imparted by having too much or too little weight on the weight belt, and it is desirable that the weight be adjustable in small increments. Further, there is a need for a weight belt which, notwithstanding having multiple weights, nevertheless has the weights constrained against slippage around the belt, while the larger number of weights enables buoyancy to be adjusted in smaller increments.

Another difficulty encountered is lack of balance of a diver during vertical ascents and descents, there being a need to avoid body inclination, and a further object of the invention is to provide means whereby balance can be easily achieved.

Another difficulty which is frequently encountered is that the weights tend to work their way around the torso of a swimmer when under the water and has a much greater tendency to hang from beneath the torso than to remain in position over the hips, and this is uncomfortable and can in some instances cause difficulties for the swimmer. There is also a danger, and a displaced weight belt can be a safety hazard, in that it is not readily released when the buckle is displaced from its central front portion. Another object of the invention is to provide a weight belt which is less likely to work its way around the torso of a swimmer.

For environmental reasons it is desirable that lead weights should not be exposed to the water for excessive periods at a time, because of the toxicity of the lead, and it is an object of this invention to provide a belt wherein the weights can themselves be covered with a layer of plastics material without increasing the danger of the belt slipping around the torso. It is a further object to provide a belt which can have the weight increased at the front and reduced at the rear to inhibit such rotational movement and ensure vertical diver balance.

It is already known to provide a weight belt with a plurality of pockets containing lead shot, and such a belt also overcomes the difficulties related to belts having a plurality of weights threaded thereon. However adjustment of such belts is not always simple to effect, unless the lead shot is contained in removable pouches, but it remains necessary to remove the belt to remove or replace a pouch, this being a procedure sometimes necessary in deep water wherein pressure compresses a wet suit and buoyancy is lost. Because of the tendency of lead shot to occupy a spherical shape, that type of weight belt usually also has a "high profile". A further object of this invention is to provide improvements whereby adjustment is readily achieved without the need for a high profile.

When diving deeply, some buoyancy is lost due to compression, and it is a further object to provide access means to enable a diver to temporarily remove some weight.

PRIOR ART

Some of the abovementioned difficulties are well known, and the U.S. Pat. No. 4,732,305 (Courtney et al) and 4,440,525 (Perla) both describe and illustrate weight belts wherein weights are contained in pockets. Perla also discloses a means whereby weights can be removed by removal of the belt and opening of the pockets. However, the Perla device does not provide the very essential "low profile", nor means for weight adjustment in small increments (other than by substitution of large weights of different size), nor means to easily achieve balance and avoid body inclination during ascent or descent, since most of the weight is located behind the back. Still further, it is necessary to remove the belt for temporary weight reduction in a deep dive. Most of the abovementioned differences also exist in the Courtney disclosure U.S. Pat. No. 4,732,305.

BRIEF SUMMARY OF THE INVENTION

In this invention, a weight belt comprises a sheet of flexible material having two strips of material over one face and joined by stitching seams to form a number of pockets side-by-side, the pockets containing plates of lead, and being closed by further folding of the sheet to bring the pockets face to face, where they are retained by touch-and-hold material. They can be lifted away for adding or reducing the number of lead plates. Access to some of the plates can be provided to allow removal or replacement without necessarily removing the belt.

More specifically, the invention consists of a weight belt which comprises a sheet of flexible material having a strip of material over a face of the sheet, a plurality of stitching seams extending across the strip retaining the strip in contiguity with said sheet face and dividing into a plurality of pockets, a plurality of weight plates in respective said pockets, retention means on the pockets which are effective in retaining the pockets in face-to-face contiguity upon folding of the sheet along a fold zone to bring the pockets into said face-to-face contiguity, and releasable fastening means on the ends of the belt co-operable to retain the belt in a loop.

In one embodiment of this invention, a weight belt comprises two rows of pockets on a foldable sheet of material, containing the lead plates, the sheet of material having belt webbing extending from both ends of one of the row of pockets and having buckle fastening means, the pockets being spaced from one another such that the sheet of material can be folded to place the pockets of one row contiguous with those of the other row, and releasably retained together firstly by touch-and-hold material, and secondly by the belt buckle pressing the other row of pockets against the diver's body.

With this arrangement, use is made of relatively small weights (say 500 grams) and each pocket can contain one or more weights. Thus it is possible to achieve a buoyancy within 250 grams of being neutral. This will avoid excessive fatigue to a diver. It is particularly useful for compensating for wet suit compression at depth, by simple temporary removal of some of the weights underwater.

The weights can be coated with a plastics material which will inhibit damage to the environment, but the pockets will retain the weights against displacement as would occur if the larger weights were plastic coated and carried traditionally on belts.

DETAILED DESCRIPTION OF THE PREFERRED EMBODIMENT

Figure 1:
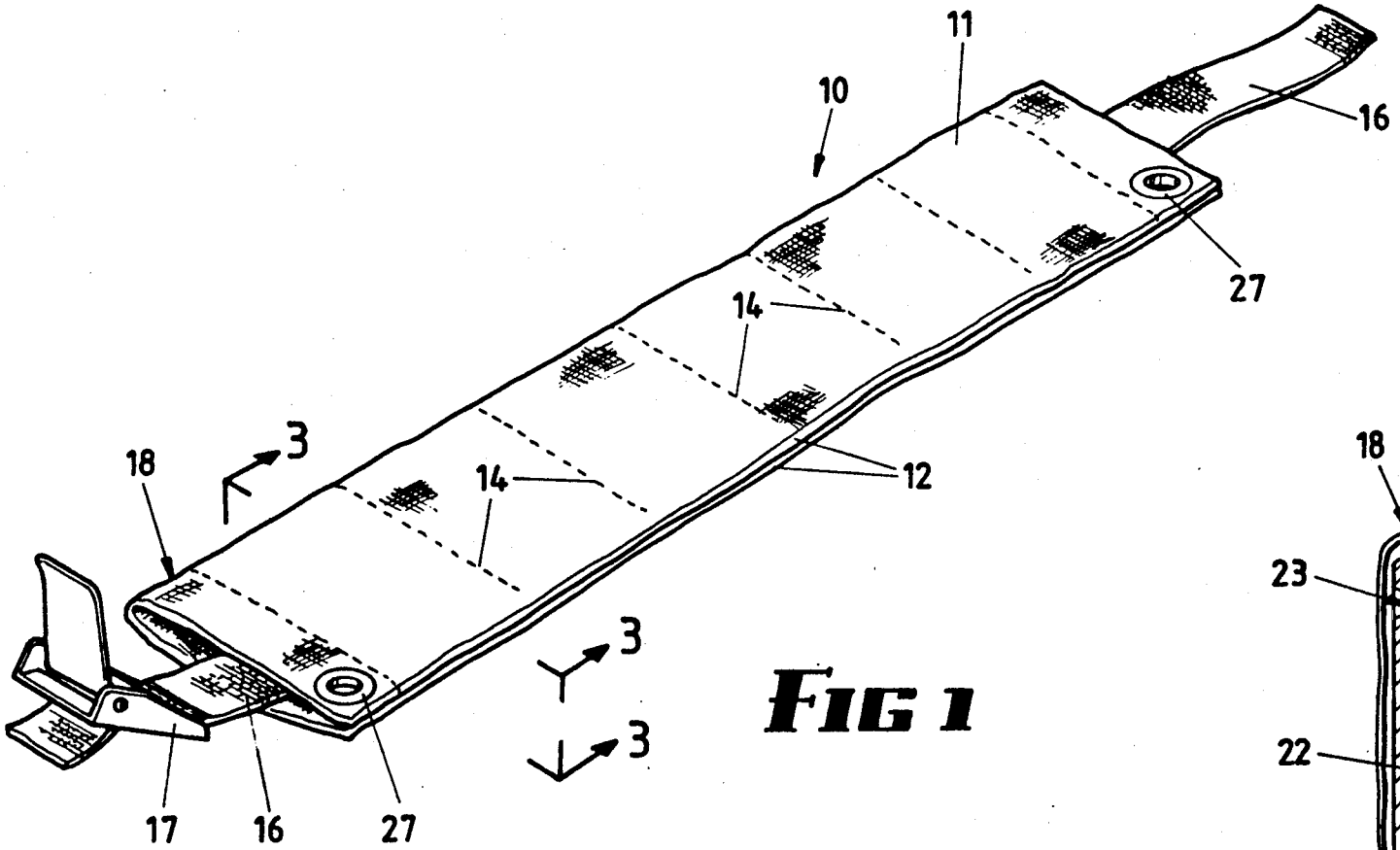
Figure 3:
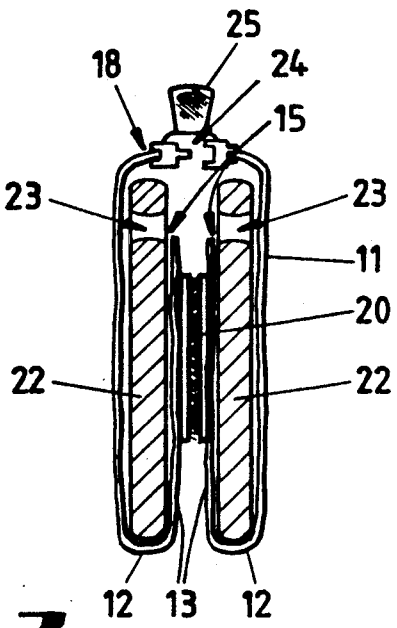
Figure 2:
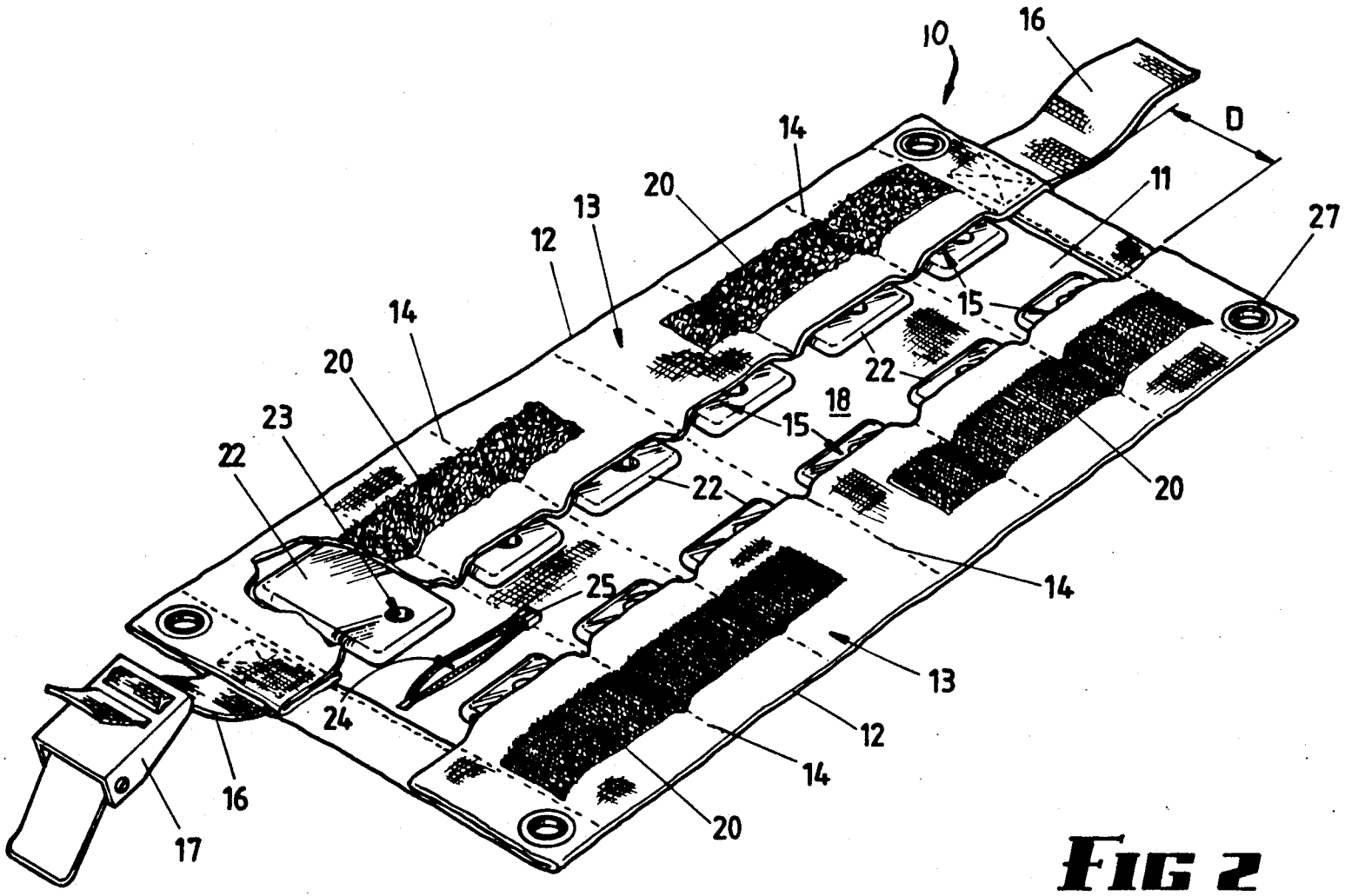

An embodiment of the invention is described hereunder in some detail with reference to, and is illustrated in, the accompanying drawings, in which:

FIG. 1 is a perspective view of a weight belt folded showing the outer portion of the sheet when worn, FIG. 2 is a perspective view of same when unfolded, and FIG. 3 is a section on plane 3—3—3 of FIG. 1, and drawn to a larger scale.

In this embodiment, a weight belt 10 comprises a sheet of woven tough material 11 sold under the Registered Trade Mark "CORDURA" by DuPont of USA, and this is folded along longitudinal fold lines 12 to provide two side strips 13 of the same material, and a plurality of transverse stitching seams 14 spaced longitudinally from one another to form series of pockets 15.

One of the side strips 13 also overlies extending belt webbing lengths 16 of woven nylon which is similar to belts commonly used in weight belts, and one length 16 is provided with a buckle 17, with which the other length 16 is releasably co-operable to retain the belt in a loop.

When unfolded as in FIG. 2, the side strips 13 are spaced apart by distance 'D', and in the intervening area the sheet 11 constitutes a fold zone 18 and the sheet can be folded upon itself as shown in FIGS. 1 and 3.

Two strips of touch-and-hold material 20 are sewn along each of the side strips 13 near their outer edges, and when the sheet 11 is folded upon itself about fold zone 18 these contact one another and assist in retaining the sheet in a folded condition (FIGS. 1 and 3). When worn, the outer portion of the sheet 11 is the portion carrying the belt lengths 16, and further assists in retaining the sheet in its folded condition.

A plurality of small flat weights 22, being plates of lead, are contained in respective pockets 15, each weight 22 being covered with a plastic coating. Surfaces define an aperture 23 in each weight 22 which performs a dual function of enabling the weight to be covered with plastic by dipping, and also for retaining the weights 22 when not required on a suspension line or pin. This may be required by a diver when in a deep dive and loses some buoyancy, and an access opening 24 provides means for temporary removal or replacement of one or more weights. This may be closed by a zip fastener 25, a folding tongue of material, or other means.

The weight 22 can be of any arbitrarily selected mass but in this embodiment they are of 500 gram weights so that the number of weights inserted into each of the pockets 15 can be varied, and desirably the weights can be reduced at the rear of the torso and increased at the front so that the tendency for the belt to slip is reduced. Furthermore, since the weights are relatively small, they can be added or subtracted to provide a swimmer with neutral buoyancy and thereby provide means whereby he can be required only to use minimal effort when submerged. Thus for example, when changing from salt to fresh water or vice versa, the number of weights required to be changed can be reduced but very easily added or taken from the pockets. The weight plates 22 are normally flat, but being of lead and thin, can be deformed by hand to comply with body contours. Eyelets 27 perform the dual function of providing means for fastening a lanyard, and also means to positively retain the belt in its folded form.

The above description is of an embodiment wherein the pockets face each other when the sheet is unfolded. They can however be equally conveniently arranged to face in opposite directions from a central stitching seam extending along a single strip lying centrally along one face of the sheet. The sheet is then folded along that stitching seam, and is used with the stitching seam lowermost, the folded edges being retained together by a zip or other fasteners.

Consideration of the above embodiment will indicate the invention to be very simple but nevertheless results in means whereby slippage of the weight belt can be substantially eliminated, damage to the environment can be diminished considerably by utilising plastic covered weights, the weights are easily stored, the weight belt is readily adjusted for neutral buoyancy, desirably each pocket can be arranged to contain two weights and thereby double the possible capacity of the weight belt, the weights can be arranged for the most convenient bias for the swimmer, and changes can be made with a minimum of time and effort.

I claim:

1. A weight belt comprising a sheet of flexible material having two side strips directed towards each other from respective sides of the sheet over a face of the sheet, a plurality of stitching seams, extending across both the side strips, retaining the side strips in contiguity with said sheet face and dividing both said side strips into a plurality of pockets, a plurality of weight plates in respective said pockets, retention means on the side strips which are effective in retaining the side strips in face-to-face contiguity upon folding of the sheet along a fold zone between the side strips to bring the side strips into said face-to-face contiguity, and releasable fastening means on the ends of the belt co-operable to retain the belt in a loop.

2. A weight belt according to claim 1 wherein said side strip retention means comprise at least one touch-and-hold fastener overlying side strip pockets.

3. A weight belt according to claim 1 wherein said side strip retention means comprise touch-and-hold fasteners overlying pockets of each said side strip which abut and releasably interengage upon said folding of the sheet along a fold zone.

4. A weight belt according to claim 1 wherein said releasable fastening means comprises two lengths of belt webbing extending from opposite ends of one of said side strips, and a buckle on one of said belt lengths cooperable with the other said belt length to releasably retain the belt in a loop.

5. A weight belt according to claim 1 wherein said side strips are folded portions of said sheet extending over said face along opposite sides of said sheet.

6. A weight belt according to claim 1 wherein said weight plates comprise lead and are of such thickness as to be readily deformable.

7. A weight belt according to claim 1 wherein each said weight plate comprises a surface defining a suspension aperture near one end thereof.

* * * * *